US012241330B1

(12) United States Patent
Acosta Villarreal et al.

(10) Patent No.: US 12,241,330 B1
(45) **Date of Patent: *Mar. 4, 2025**

(54) TIGHT TOLERANCE PACKER

(71) Applicant: HALLIBURTON ENERGY SERVICES, INC., Houston, TX (US)

(72) Inventors: Frank Vinicia Acosta Villarreal, Houston, TX (US); Saul Emmanuel Vazquez Niebla, Houston, TX (US); Ahmad Rizal Maharam, Senai (MY)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/239,254

(22) Filed: Aug. 29, 2023

(51) Int. Cl.
*E21B 33/12* (2006.01)

(52) U.S. Cl.
CPC ..... *E21B 33/12* (2013.01)

(58) Field of Classification Search
CPC .. E21B 33/1208; E21B 33/12; E21B 33/1204; E21B 33/1212; E21B 33/1216; E21B 33/122; E21B 33/124; E21B 33/1243; E21B 33/1246; E21B 33/126; E21B 33/1265; E21B 33/127; E21B 33/1275; E21B 33/1277; E21B 33/128; E21B 33/1285; E21B 33/129; E21B 33/1291; E21B 33/1292; E21B 33/1293; E21B 33/1294; E21B 33/1295; E21B 33/12955
See application file for complete search history.

(56) References Cited

U.S. PATENT DOCUMENTS 2,925,865 A * 2/1960 Owen ..... E21B 33/16 166/117
3,097,699 A 7/1963 Orr
3,148,731 A 9/1964 Holden
3,221,818 A * 12/1965 Taylor ..... E21B 33/1285 166/182
3,358,770 A 12/1967 Zandmer
3,417,822 A 12/1968 Howell
3,451,476 A 6/1969 Pitts
(Continued)

FOREIGN PATENT DOCUMENTS

EP 1262629 A1 12/2002
EP 2826951 A2 1/2015
(Continued)

OTHER PUBLICATIONS

International Search Report and Written Opinion dated Nov. 7, 2023, issued in PCT Application No. PCT/US2023/029006.
(Continued)

*Primary Examiner* — David Carroll
(74) *Attorney, Agent, or Firm* — McAfee & Taft

(57) ABSTRACT

A packer for use in a well has a packer mandrel with a stepped outer surface defining first, second and third progressively smaller outer diameters. The third outer diameter is a reduced outer diameter portion. A setting sleeve with a stepped inner surface defining first and second inner diameters is engaged with and slidable on the second and third outer diameters on the outer surface of the packer mandrel. A packer element is disposed about the reduced outer diameter portion of the packer mandrel and the setting is sleeve movable from a first position to a second position on the packer mandrel.

19 Claims, 10 Drawing Sheets

(56) References Cited

U.S. PATENT DOCUMENTS

| | | | | |
|---|---|---|---|---|
| 3,789,926 | A | 2/1974 | Henley et al. | |
| 3,948,322 | A | 4/1976 | Baker | |
| 4,286,662 | A | 9/1981 | Page, Jr. | |
| 4,487,263 | A | 12/1984 | Jani | |
| 4,674,569 | A | 6/1987 | Revils et al. | |
| 4,842,062 | A | 6/1989 | Schneider et al. | |
| 5,024,273 | A | 6/1991 | Coone et al. | |
| 5,109,925 | A | 5/1992 | Stepp et al. | |
| 5,279,370 | A | 1/1994 | Brandell et al. | |
| 5,368,098 | A | 11/1994 | Blizzard, Jr. et al. | |
| 5,411,095 | A | 5/1995 | Ehlinger et al. | |
| 5,433,269 | A | 7/1995 | Hendrickson | |
| 5,433,275 | A * | 7/1995 | Melenyzer | E21B 17/06 166/380 |
| 5,443,124 | A | 8/1995 | Wood et al. | |
| 5,647,434 | A | 7/1997 | Sullaway et al. | |
| 5,765,641 | A | 6/1998 | Shy et al. | |
| 6,026,903 | A | 2/2000 | Shy et al. | |
| 6,244,342 | B1 | 6/2001 | Sullaway et al. | |
| 6,425,442 | B1 | 7/2002 | Latiolais, Jr et al. | |
| 6,796,377 | B2 | 9/2004 | Butterfield, Jr. et al. | |
| 6,802,373 | B2 | 10/2004 | Dillenbeck et al. | |
| 7,237,611 | B2 | 7/2007 | Vincent et al. | |
| 7,857,052 | B2 | 12/2010 | Giroux et al. | |
| 7,866,392 | B2 | 1/2011 | Rogers et al. | |
| 7,866,402 | B2 | 1/2011 | Williamson, Jr. | |
| 8,215,404 | B2 | 7/2012 | Makowiecki et al. | |
| 8,616,276 | B2 | 12/2013 | Tips et al. | |
| 8,646,537 | B2 | 2/2014 | Tips et al. | |
| 8,720,561 | B2 | 5/2014 | Zhou | |
| 9,010,442 | B2 | 4/2015 | Streich et al. | |
| 9,121,255 | B2 | 9/2015 | Themig et al. | |
| 9,291,007 | B2 | 3/2016 | Darbe et al. | |
| 9,376,886 | B2 | 6/2016 | Acosta | |
| 9,441,440 | B2 | 9/2016 | Hofman et al. | |
| 9,441,446 | B2 | 9/2016 | Fripp et al. | |
| 9,506,324 | B2 | 11/2016 | Kyle et al. | |
| 9,587,486 | B2 | 3/2017 | Walton et al. | |
| 9,816,351 | B2 | 11/2017 | Lirette et al. | |
| 9,856,714 | B2 | 1/2018 | Giroux | |
| 9,920,620 | B2 | 3/2018 | Murphree et al. | |
| 10,024,150 | B2 | 7/2018 | Andreychuk et al. | |
| 10,030,472 | B2 | 7/2018 | Fripp | |
| 10,316,619 | B2 | 6/2019 | de Oliveira et al. | |
| 10,358,914 | B2 | 7/2019 | Roberson et al. | |
| 10,557,329 | B2 | 2/2020 | Gao et al. | |
| 10,718,179 | B2 | 7/2020 | Stair et al. | |
| 11,280,157 | B2 | 3/2022 | Acosta et al. | |
| 11,293,253 | B2 | 4/2022 | Santoso et al. | |
| 2006/0207765 | A1 | 9/2006 | Hofman | |
| 2007/0261850 | A1 | 11/2007 | Giroux et al. | |
| 2008/0251253 | A1 | 10/2008 | Lumbye | |
| 2009/0071655 | A1 | 3/2009 | Fay | |
| 2009/0151960 | A1 | 6/2009 | Rogers et al. | |
| 2009/0277651 | A1 | 11/2009 | Kilgore | |
| 2010/0038074 | A1 * | 2/2010 | Patel | E21B 33/1216 166/187 |
| 2010/0051276 | A1 | 3/2010 | Rogers et al. | |
| 2010/0163253 | A1 | 7/2010 | Caldwell et al. | |
| 2010/0206572 | A1 | 8/2010 | Makowiecki | |
| 2013/0048290 | A1 | 2/2013 | Howell et al. | |
| 2013/0233570 | A1 | 9/2013 | Acosta et al. | |
| 2013/0233572 | A1 | 9/2013 | Helms et al. | |
| 2013/0312965 | A1 | 11/2013 | Themig et al. | |
| 2015/0027706 | A1 | 1/2015 | Symms | |
| 2015/0184489 | A1 | 7/2015 | Resweber | |
| 2015/0198005 | A1 * | 7/2015 | Delzell | E21B 33/128 166/180 |
| 2015/0285025 | A1 * | 10/2015 | Hughes | E21B 34/14 166/308.1 |
| 2016/0208577 | A1 * | 7/2016 | Byberg | E21B 33/128 |
| 2017/0145784 | A1 * | 5/2017 | Zhou | E21B 33/128 |
| 2018/0038192 | A1 | 2/2018 | Stair et al. | |
| 2018/0320473 | A1 | 11/2018 | Xu et al. | |
| 2019/0017366 | A1 | 1/2019 | Alaas et al. | |
| 2019/0249549 | A1 | 8/2019 | Fripp et al. | |
| 2020/0270967 | A1 | 8/2020 | Fong et al. | |
| 2021/0010345 | A1 | 1/2021 | Acosta et al. | |
| 2022/0195835 | A1 | 6/2022 | Acosta Villarreal et al. | |
| 2022/0349272 | A1 | 11/2022 | Patil et al. | |
| 2022/0349273 | A1 | 11/2022 | Dharne et al. | |

FOREIGN PATENT DOCUMENTS

| | | | |
|---|---|---|---|
| WO | 2014107805 | A1 | 7/2014 |
| WO | 2016118018 | A1 | 7/2016 |
| WO | 2022132183 | A1 | 6/2022 |

OTHER PUBLICATIONS

International Search Report and Written Opinion dated Sep. 20, 2023, issued in PCT Application No. PCT/US2023/024098.

Halliburton Catalog titled "Casing Equipment" (2015), entire catalog.

Halliburton Brochure, "Cementing ES II Stage Cementer,," Feb. 2013.

Halliburton Brochure, "Fidelis Stage Cementer," Sep. 2013.

International Search Report and Written Opinion issued Apr. 5, 2021, in PCT Application No. PCT/US2020/053694.

International Search Report and Written Opinion issued Jun. 20, 2022, in PCT Application No. PCT/US2022/020696.

Halliburton Installation and Operating Instructions, OBSIDIO 9-5/8" Multiple Stage Mechanical Packer Collar, pp. 12, 13, 17 and 18, May 2021.

PCT International Search Report and Written Opinion issued Oct. 15, 2024 in PCT/US2024/036364, pp. 1-12.

PCT International Search Report and Written Opinion issued Oct. 15, 2024 in PCT/US2024/036375, pp. 1-11.

* cited by examiner

TIGHT TOLERANCE PACKER

The field relates to packers used in the oil and gas industry. Compression packers provide economical and efficient solutions for wellbore isolation, and in particular for casing to casing isolation. There are situations, however, where the annular space between the previously installed outer casing and the inner casing to be installed in the outer casing is so small that sealing with a conventional tool is difficult, and sometimes not possible, because the size of the tool relative to the size of the casing in which it is deployed would require a packer element so thin that it would not generate a proper seal. When the packer element lacks sufficient thickness, folds in the element can be created that prevent an adequate seal.

When a casing is lowered into a well, the packer mandrel typically will have a maximum outer diameter that is the same as the outer diameter of the casing on which it is lowered. The packer element, prior to being moved to the set position, will likewise have the same outer diameter as the casing on which it is lowered. A setting sleeve will be disposed about the packer mandrel. The portion of the mandrel about which the setting sleeve moves has a single stepped down portion that defines an outer diameter that is smaller than the outermost portion of the mandrel, and in prior art packers, the packer element is supported on the stepped down portion. As a result, the thickness of the packer element will not be thick enough in many scenarios to generate a competent seal.

BRIEF DESCRIPTION OF THE DRAWINGS

FIG. 6 is an enlarged partial cross section of a portion of the embodiment of FIG. 5.

FIG. 9 is an elevation view of the packer shoe of the embodiment of FIG. 5 positioned on the packer.

FIG. 10 is a cross section of the packer shoe of embodiment 5.

FIG. 11 is a perspective view of the packer shoe of the embodiment of FIG. 5.

FIG. 12 is a perspective view of a lock ring of the embodiment of FIG. 5.

DESCRIPTION OF AN EMBODIMENT

Figure 1:
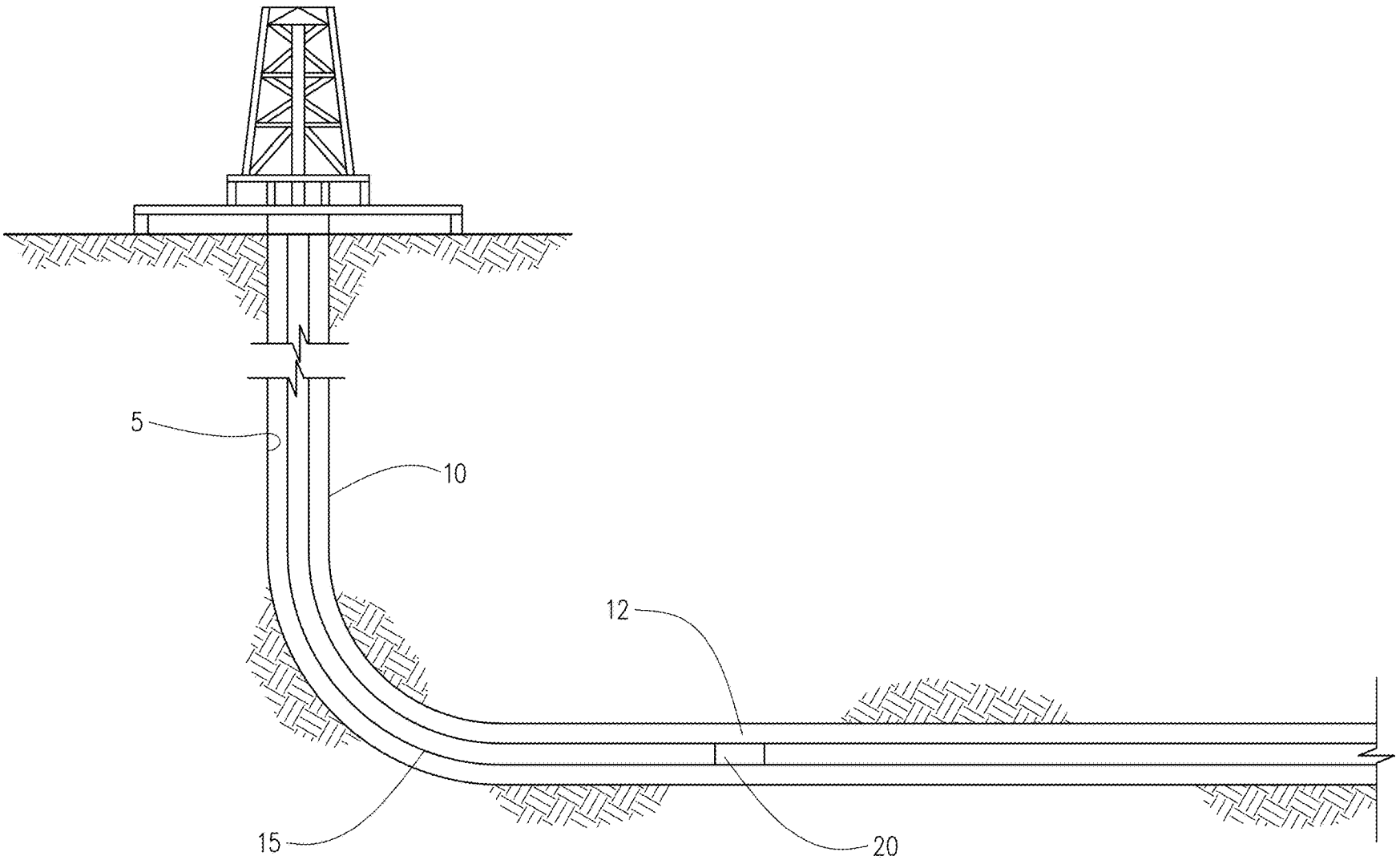
FIG. 1 is a schematic showing a casing with a compression packer in a wellbore.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described. It should also be understood that, as used herein, "first," "second," and "third" are assigned arbitrarily and are merely intended to differentiate between two or more components, flow ports, etc., as the case may be, and does not indicate any sequence. Furthermore, it is to be understood that the mere use of the word "first" does not require that there be any "second," and the mere use of the word "second" does not require that there be any "third," etc.

Unless otherwise specified, use of the terms "up," "upper," "upward," "up-hole," "upstream," or other like terms shall be construed as generally toward the surface; likewise, use of "down," "lower," "downward," "down-hole," "downstream," or other like terms shall be construed as generally away from the surface, regardless of the wellbore orientation. Use of any one or more of the foregoing terms shall not be construed as denoting positions along a perfectly vertical axis. A wellbore can include vertical, inclined or horizontal portions, and can be straight or curved.

FIG. 1 shows apparatus 20, which in one embodiment is an isolation tool 20 lowered into a wellbore 10 on a casing string 15. Casing 15 may be referred to as an inner casing 15. In the embodiment described, isolation tool 20 is a packer 20, and is depicted in a horizontal portion of a wellbore 10 in which a casing 5 has already been installed. Packer 20 is designed for efficient use in shallow or deep wells and for use in high pressure, high temperature wells. Packer 20 is designed to support a hydrostatic column of cement and uses only one plug to set the packer 20. Other tools, such as for example a stage cementing tool may be included in the casing string 15. Any number of different tools may be connected in casing string 15 and used in connection with packer 20. A minimum amount of drill out is needed after the packer 20 is set, since only a single plug is required to set the packer 20.

Figure 2:
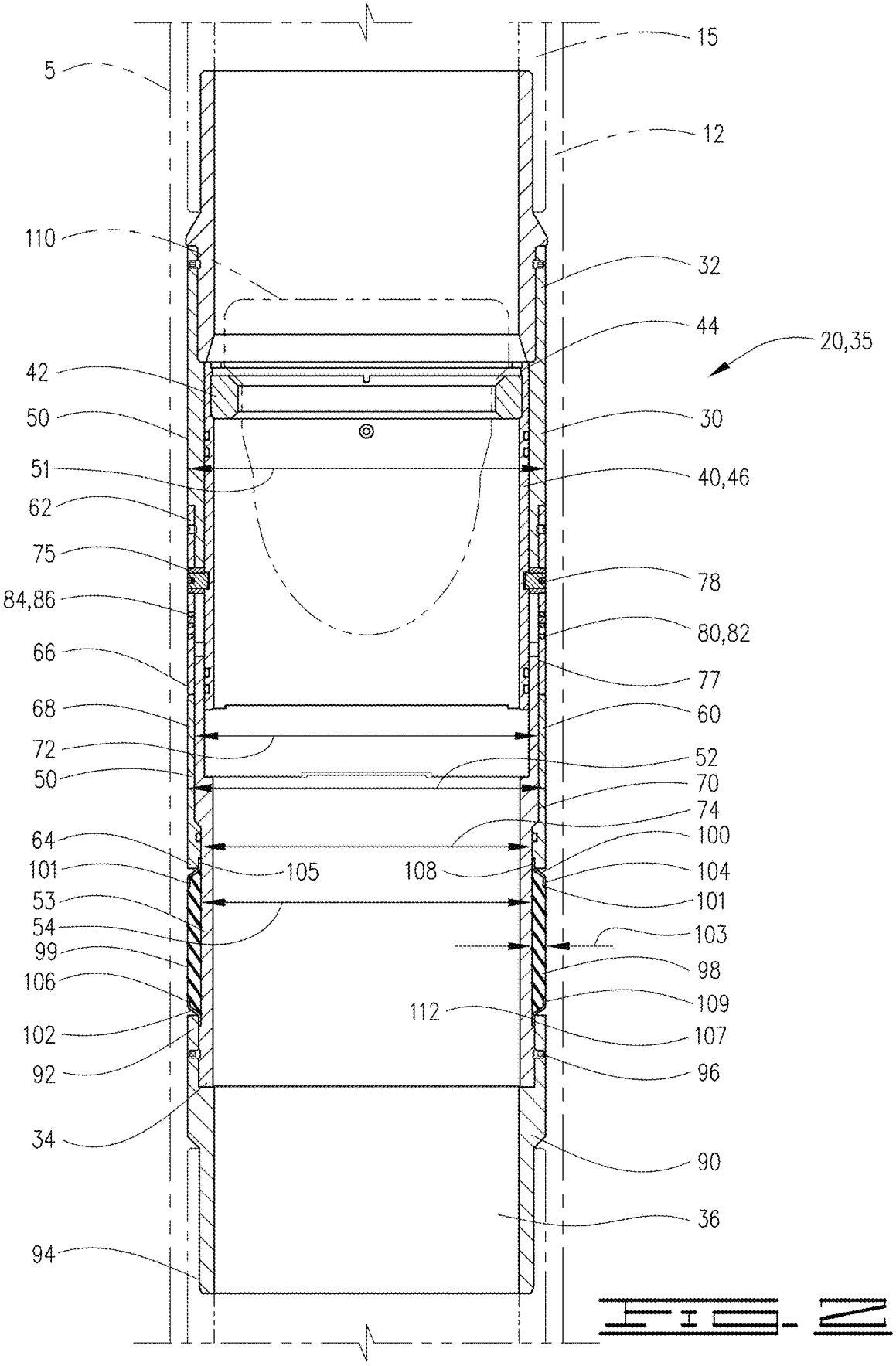
FIG. 2 is a cross section of a compression packer in a run-in position.

An annulus 12 is defined by and between packer 20 and wellbore 10. Although depicted in wellbore 10 with casing 5 therein, it is understood that use of the packer 20 is not so limited, and may be used in an uncased wellbore. Likewise, while packer 20 is shown in a horizontal portion of a wellbore, it is understood that the compression packer 20 may be used in a vertical wellbore portion as well. Packer 20 comprises a packer body, or packer mandrel 30 with upper end 32 and lower end 34. Packer 20 is shown in a first, or run-in position 35 in FIG. 2. Packer 20 is movable to a set position 37 in which the packer seals against the outer casing 5 that has been previously installed in the wellbore 10. A central flow passage 36 is defined by packer 20 to provide for the passage of fluids therethrough. Annular space 12 in many cases is small, and in many cases is so small that a proper seal is difficult, and in some cases impossible to achieve. The packer disclosed herein includes a packer with a packer mandrel 30 having a reduced diameter portion, which provides for a packer element of sufficient thickness to provide a proper seal against the well.

A sliding sleeve 40 is slidably disposed in packer mandrel 30. Sliding sleeve 40 is shown in a first position 46 in FIG. 2, which corresponds to the run-in position 35 of the packer 20. Sliding sleeve 40 moves to a second position which corresponds to the set position of the packer, and may move to a third position in the mandrel 30. Sliding sleeve 40 has a plug seat 42 at an upper end 44 thereof. Packer mandrel 30 has exterior or outer surface 50. Outer surface 50 defines a plurality of progressively smaller mandrel outer diameters, which may include a first outer diameter 51, a second outer diameter 52 and a third or reduced outer diameter 54 on a reduced diameter portion 53.

With prior art compression packers, the outer surface of the prior art packer mandrel is reduced for the setting sleeve, so that the outermost diameter of the setting sleeve and the outermost diameter of the packer mandrel are aligned. In prior art packers the surface of the mandrel on which the setting sleeve moves is not further reduced for the packer element, but has a constant diameter. Such an arrangement places a limitation on the thickness of the packer element in those prior art tools, since the packer element in an unset position defines an outer surface with a diameter that is generally the same as the outer diameter of the packer mandrel. The current disclosure is directed to a packer with a mandrel that has a stepped outer surface on which the setting sleeve moves, which provides additional space for the thickness of the packer element.

A setting sleeve 60 with upper end 62 and lower end 64 is slidably disposed about packer mandrel 30. Setting sleeve 60 is connected to sliding sleeve 40 with shearable drive pins 78. Slots 76 with upper end 75 and lower end 77 are defined in packer mandrel 30. Drive pins 78 will move downwardly in slots 76 when the packer 20 is moved to a set position to seal against outer casing 5. Lower end 64 of setting sleeve 60 is a flat, or snub-nosed end, which may be described as a flat annular face. Inner surface 70 of setting sleeve 60 defines a first inner diameter 72 and a second, or reduced inner diameter portion 74. Setting sleeve 60 may comprise a two-piece setting sleeve with upper and lower portions 66 and 68 respectively. Upper portion 66 may be comprised of a different material than lower portion 68 and may be a deformable material. Lower portion 68 may be a softer steel than the upper portion 66. The setting sleeve 60 is a stepped setting sleeve, so that reduced diameter 74 on lower portion 68 will engage and slide upon the reduced outer diameter 54 of packer mandrel 30. As is apparent from the drawings, a mandrel without the reduced diameter portion would not allow the use of a tool of the desired size, and at the same time provide a packer element of sufficient thickness to create an effective seal.

A plurality of locking elements 80 are disposed in grooves 82 in setting sleeve 60. Locking elements in one embodiment may comprise lock rings 84 and a biasing element 86, which may comprise a wave spring that biases a lock ring 84 toward packer mandrel 30.

A bottom sub 90 is threaded to mandrel 30 at the lower end thereof and connects to the casing 15 therebelow. Bottom sub 90 has upper end 92 and lower end 94. Upper end 92 is a flat, snub nosed stop 92, which may be described as a flat annular face. A packer element 98 is disposed about packer mandrel 30 and has upper and lower ends 100 and 102 respectively. Packer element 98 has a thickness 103, and is disposed about reduced diameter 54. Outer diameter 54 is smaller than outer diameter 52. In the unset position of the packer element 98 the outer surface 99 thereof is aligned with outer surface 50 of packer mandrel 30 on the first outer diameter 51 thereof, which is the outermost diameter of the packer mandrel. Setting sleeve 60 engages and slides on the second and third outer diameters 52 and 54 defined by outer surface 50 of packer mandrel 30.

A leg 101 of an upper anti-extrusion element 104 covers upper end 100 of packer element 98. Upper anti-extrusion element 104 has an upwardly extending leg 105. Leg 105 encircles packer mandrel 30 above packer element 98. A lower anti-extrusion element 106 covers lower end 102 of packer element 98 and has a downwardly extending leg 107. Leg 107 encircles packer mandrel 30 below packer element 98. An annular space 108 is defined by and between setting sleeve 60 and packer mandrel 30 at the lower end 64 of setting sleeve 60. Leg 105 is positioned in space 108, and is captured between packer mandrel 30 and setting sleeve 60 at lower end 64 thereof Δn annular space 112 is defined by and between bottom sub 90 and packer mandrel 30 at the upper end 92 of bottom sub 90. Leg 107 is positioned in space 112, and is captured between packer mandrel 30 and bottom sub 90 at upper end 92 thereof. Bottom sub 90 thus acts as a cover sleeve 90 for lower anti-extrusion element 106. A leg 109 of lower anti-extrusion element 106 extends over the lower end 102 of packer element 98. Anti-extrusion elements 104 and 106 may also be referred to as upper and lower support shoes 104 and 106.

In operation, the apparatus 20 is lowered into a wellbore on casing string 15. Once the desired depth is reached, apparatus 20 may be moved to the set position in which packer element 98 is expanded radially outwardly to engage wellbore 10, which in the embodiment described is a cased wellbore, but which may also be an uncased wellbore. Packer element 98 is moved outwardly by placing the packer element 98 in compression. Apparatus 20 is moved to the set position with the use of a setting plug 110. Setting plug 110 is passed into casing 15 and will be moved downwardly therein until setting plug 110 engages setting plug seat 42. Once setting plug 110 engages setting plug seat 42, pressure is increased to move sliding sleeve 40 downwardly in packer mandrel 30. Setting sleeve 60 will move downwardly with sliding sleeve 40 since setting sleeve 60 and sliding sleeve 40 are connected with frangible drive pins 78. Pressure is continuously applied so that setting sleeve 60 is pushed into packer element 98. The setting plug 110 is shown in dashed lines in FIG. 2, and it is understood that the setting plug 110 will not engage the sliding sleeve 40 until the apparatus has reached a desired destination in the well.

Compression is applied to packer element 98 by the annular flat face at the lower end 64 of setting sleeve 60 to the upper end 100 of packer element 98. Packer element 98 is prevented from moving downward by the annular flat upper face at the upper end 92 of bottom sub 90. Compression is applied to packer 98 until it expands radially outwardly sufficiently to move to the set position in which packer element 98 engages and seals against wellbore 10. Locking elements 80 are biased toward packer mandrel 30, and will be urged into grooves in the packer mandrel 30 to hold setting sleeve 60 in place in its set position. Pressure is continuously applied in casing 15 until a sufficient pressure, which may be a predetermined pressure, is reached to apply a force to drive pins 78 that is sufficient to break the frangible drive pins 78. Once drive pins 78 are broken, sliding sleeve 40 will move downwardly in packer mandrel 30 so that the apparatus 20 is in its completed position, in which setting sleeve 60 is fixed to packer mandrel 30 with locking elements 80 such that it maintains compression on packer element 98 to keep the apparatus 20 in its set position.

Upper anti-extrusion element 104 captures upper end 100 of packer element 98 so that packer element 98 does not extrude around setting sleeve 60, and does not intrude into any gaps that may exist between setting sleeve 60 and packer mandrel 30. Leg 105 of anti-extrusion element 104 occupies the space defined between setting sleeve 60 and packer mandrel 30 to prevent the packer element 98 from intruding, or squeezing into that space. Lower anti-extrusion element 106 captures lower end 102 of packer element 98 so that packer element 98 does not extrude around bottom sub 90, and does not intrude into any gaps that may exist between packer bottom sub 90 and packer mandrel 30. Leg 107 of anti-extrusion element 106 occupies the space defined between bottom sub 90 and packer mandrel 30 to prevent the packer element 98 from intruding, or squeezing into that space.

Figure 3:
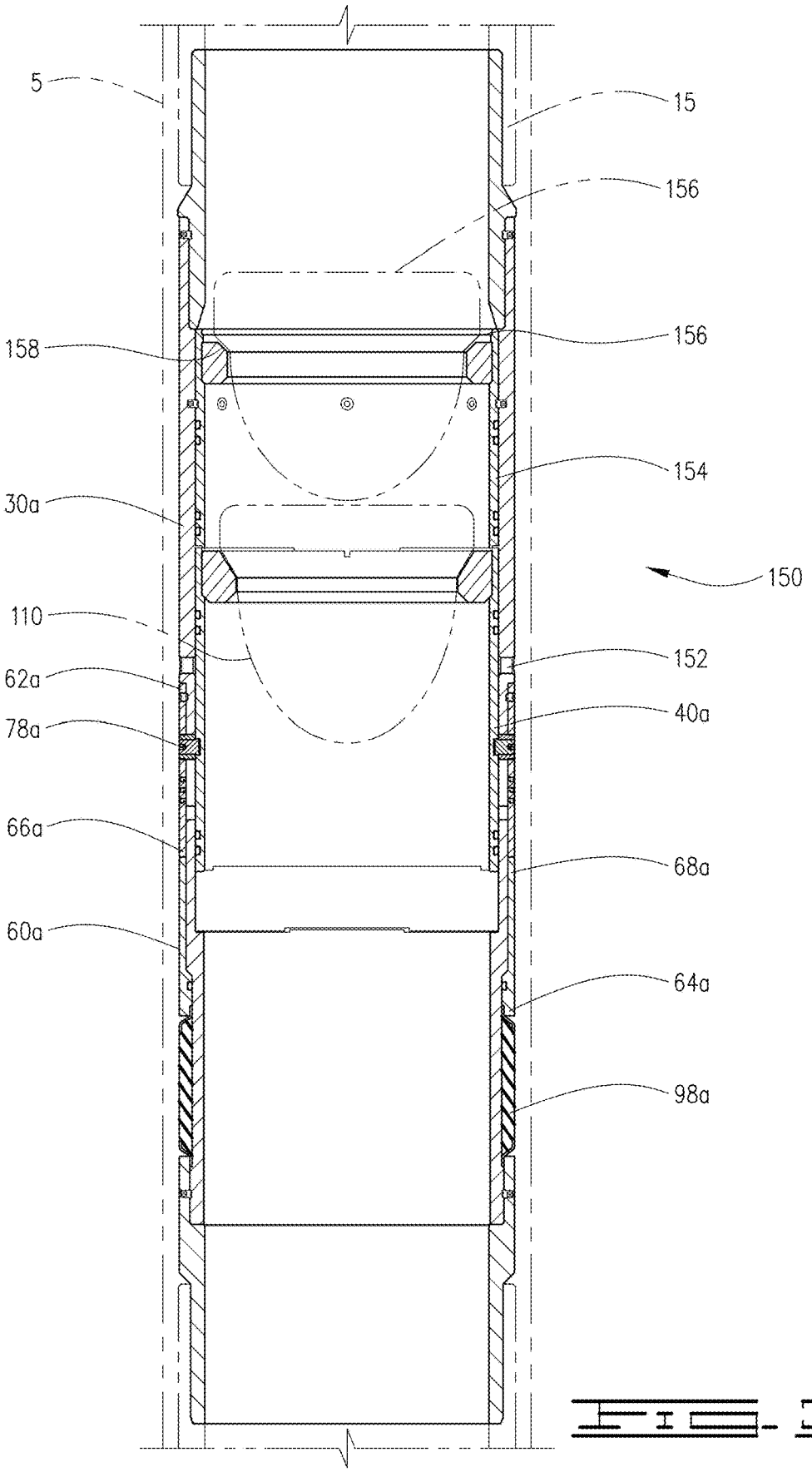
FIG. 3 is a cross section of an additional embodiment of a compression packer.
Figure 4:
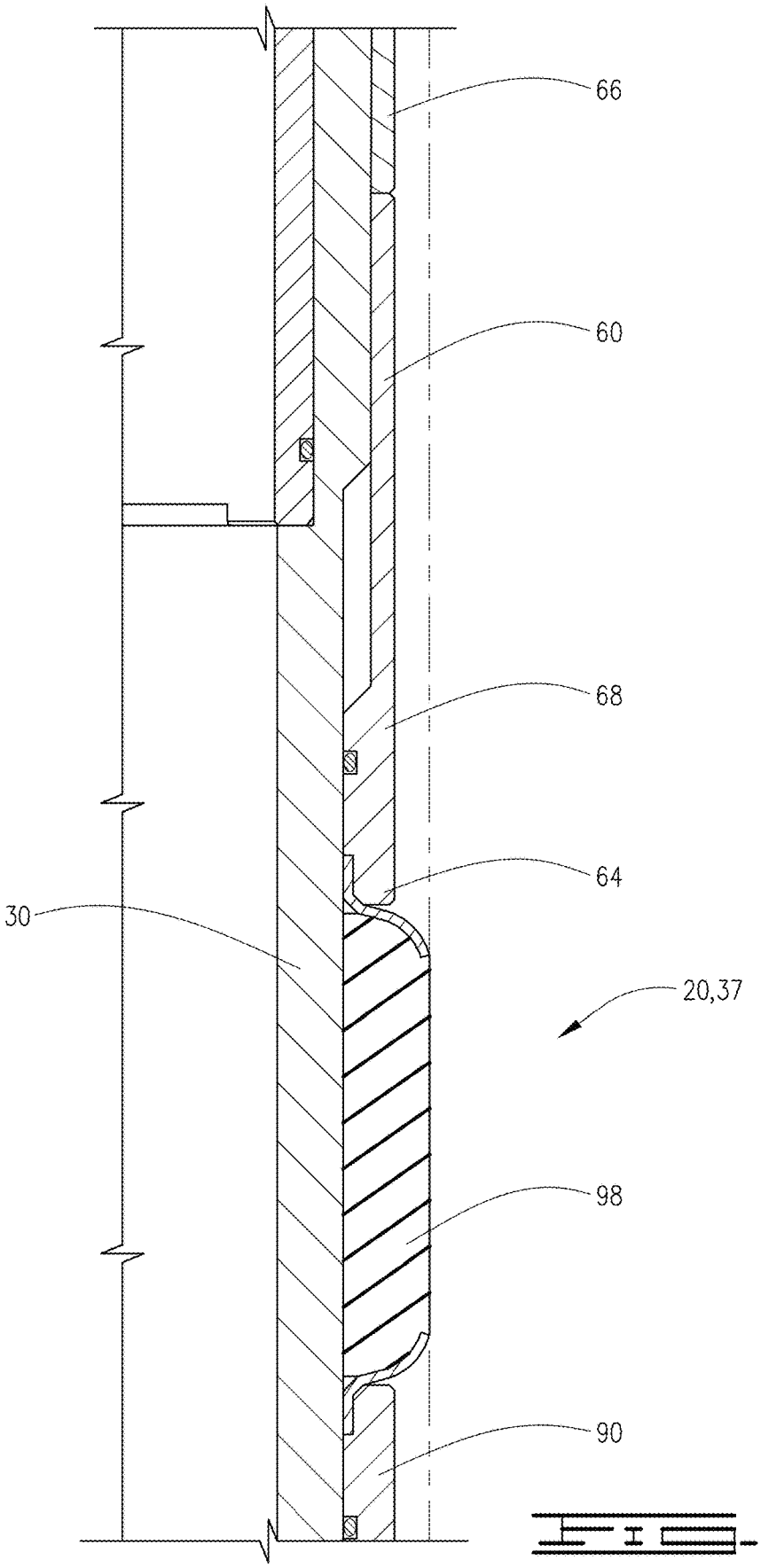
FIG. 4 is a partial cross section of the compression packer of FIG. 2 after it has been moved to a set position.

An additional embodiment of a packer 150 is shown in FIG. 3. Packer 150 is similar to packer 20, except that the packer mandrel and setting sleeve have greater length to accommodate a closing sleeve above the sliding sleeve. In the embodiment of FIG. 3, like parts are indicated using the same numbers as in FIG. 2, except that a subscript a is used. Packer mandrel 30*a* in embodiment 150 has a plurality of flow ports 152 therethrough which will communicate flow passage 36*a* with annulus 12. A closing sleeve 154 is disposed in packer mandrel 30*a* above sliding sleeve 40*a*. The operation of packer 150 is like that as described with respect to packer 20, except that after the packer 150 is moved to the set position, cement may be flowed through flow ports 152 and a closing plug 156, shown in dashed lines in FIG. 3 is dropped to engage a closing seat 158 at the upper end of closing sleeve 154, and pressure is increased to disengage the closing sleeve from the mandrel 30*a* and move the closing sleeve down to cover flow ports 152 and prevent communication therethrough. Such an arrangement might be used for example with a stage cementing tool.

Setting sleeve 60*a* may be, like setting sleeve 60, a two piece sleeve with the upper portion 66*a* being comprised of a different material than lower portion 68*a*. Lower portion 68*a* may be a softer steel than the upper portion 66*a*. The setting sleeve 60*a* is a stepped setting sleeve, so that reduced diameter lower portion 68*a* will engage and slide upon the reduced outer diameter of packer mandrel 30*a*. FIG. 3 does not show the setting sleeve moved down, and the packer set, but it is understood that the setting sleeve 60*a* will be moved down and the packer 150 moved to the set position prior to the plug 156 being released to engage the closing sleeve 154.

Figure 5:
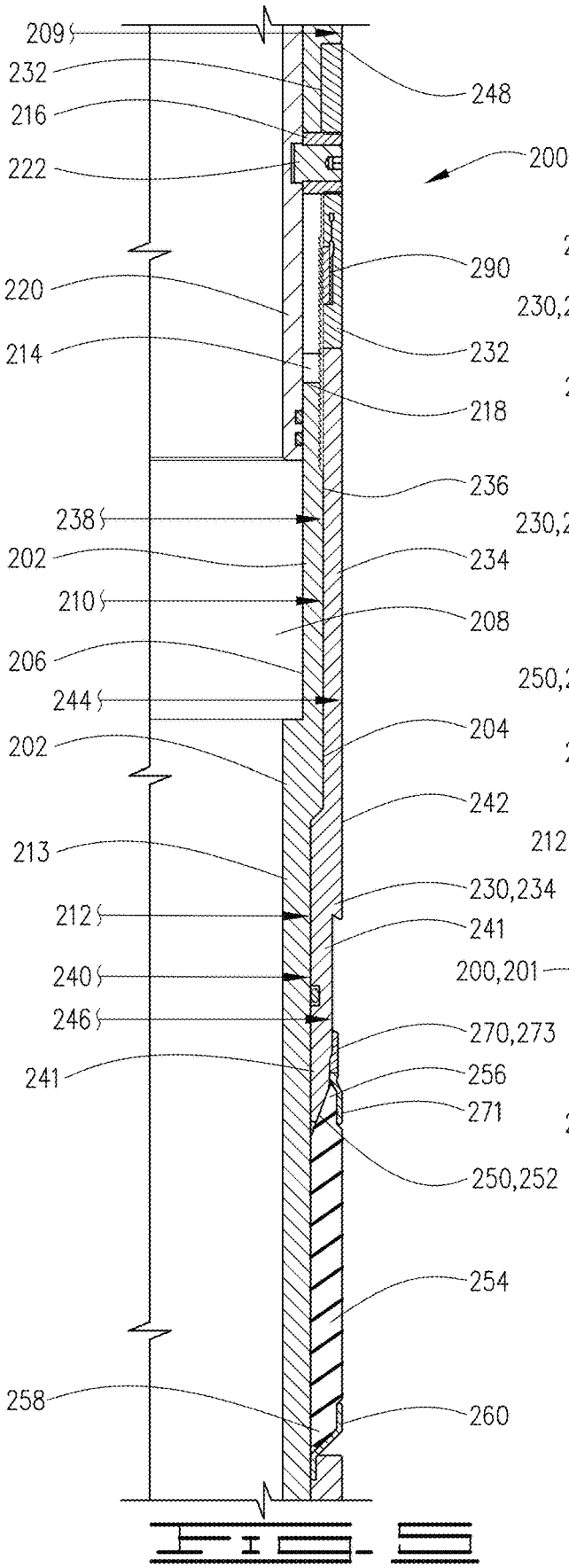
FIG. 5 is a partial cross section of an additional embodiment of a packer.
Figure 5:
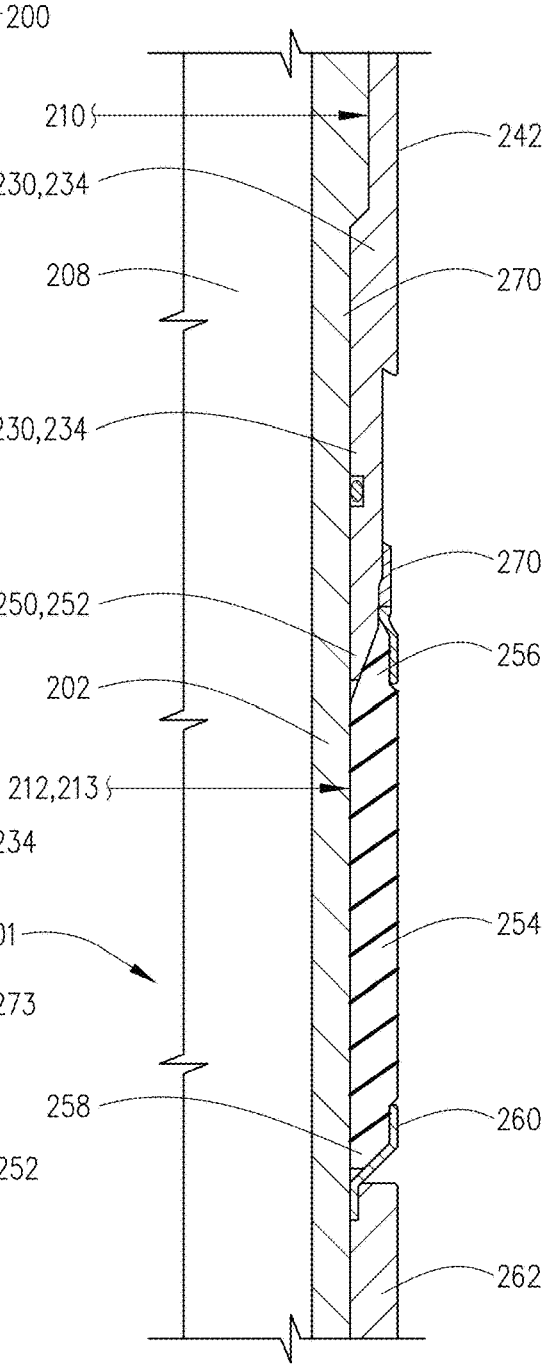
Figure 7:
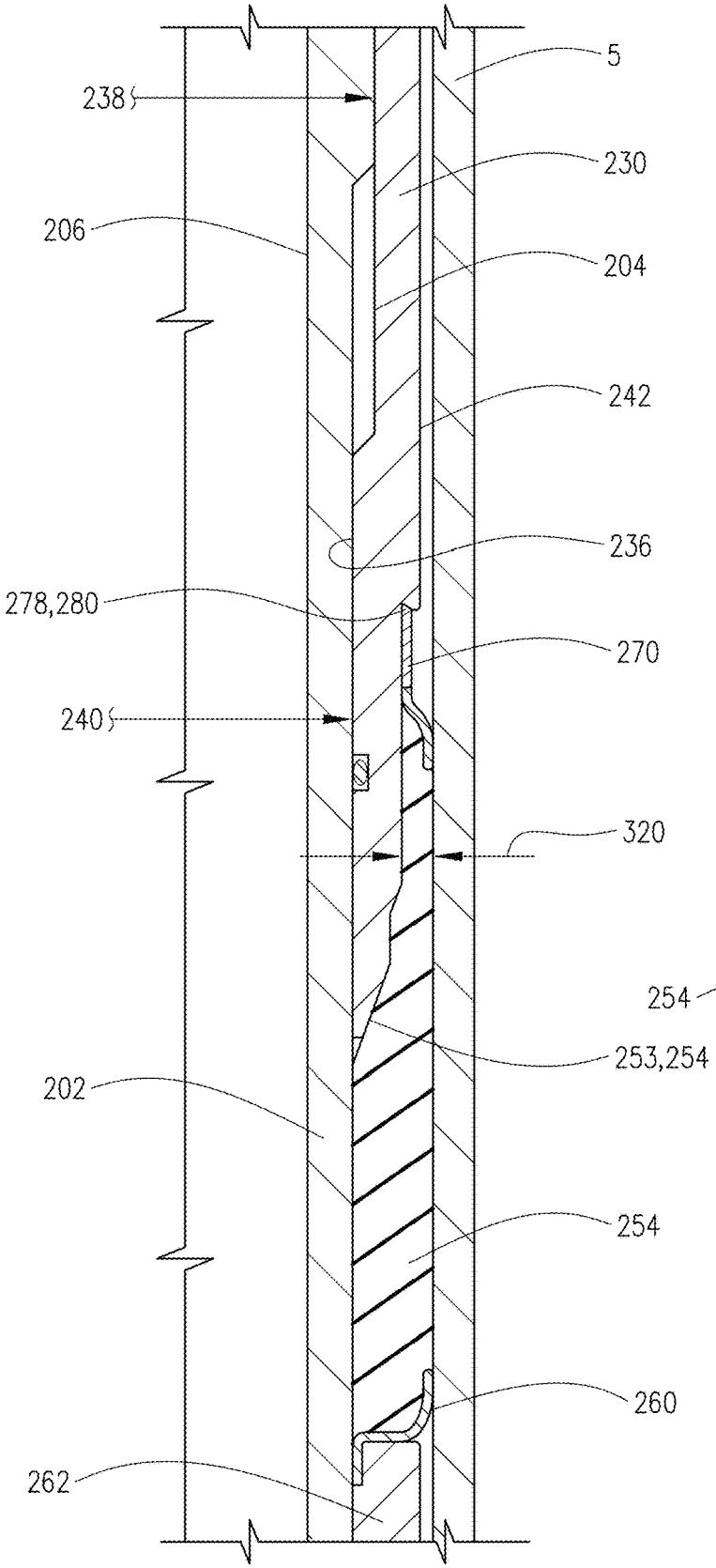
FIG. 7 is an enlarged partial cross section of a portion of the embodiment of FIG. 5 in a set position.
Figure 8:
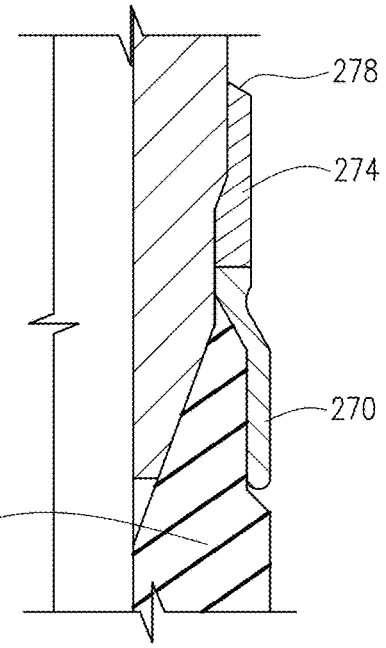
FIG. 8 is an enlarged partial cross section of a portion of the embodiment of FIG. 5 showing the packer shoe over the packer element.
Figure 7:
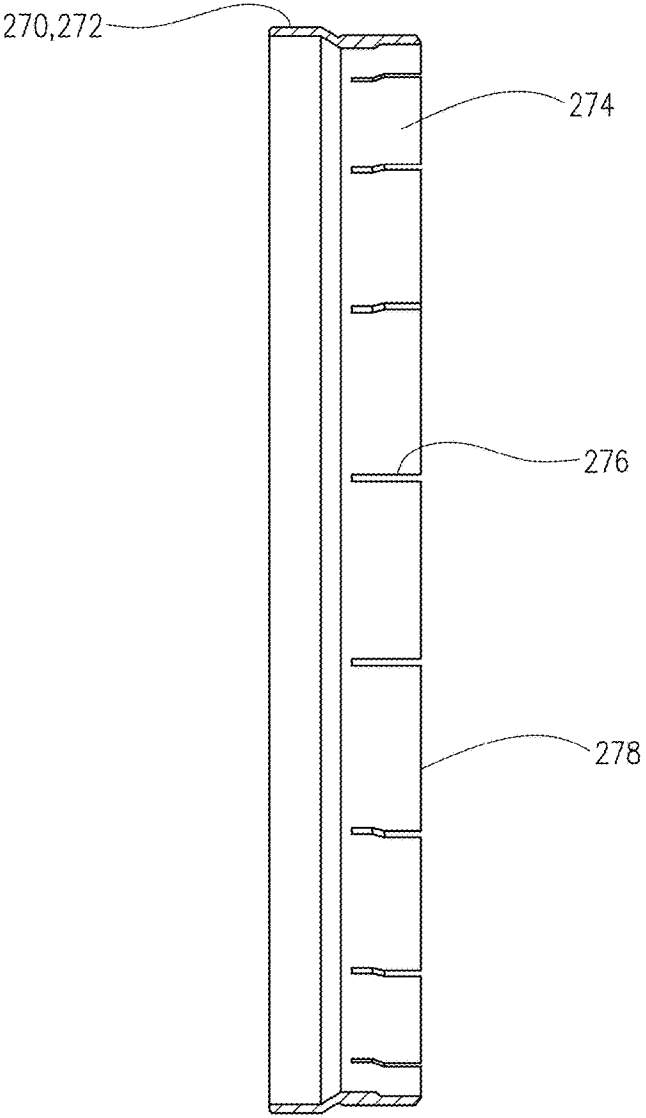
Figure 8:
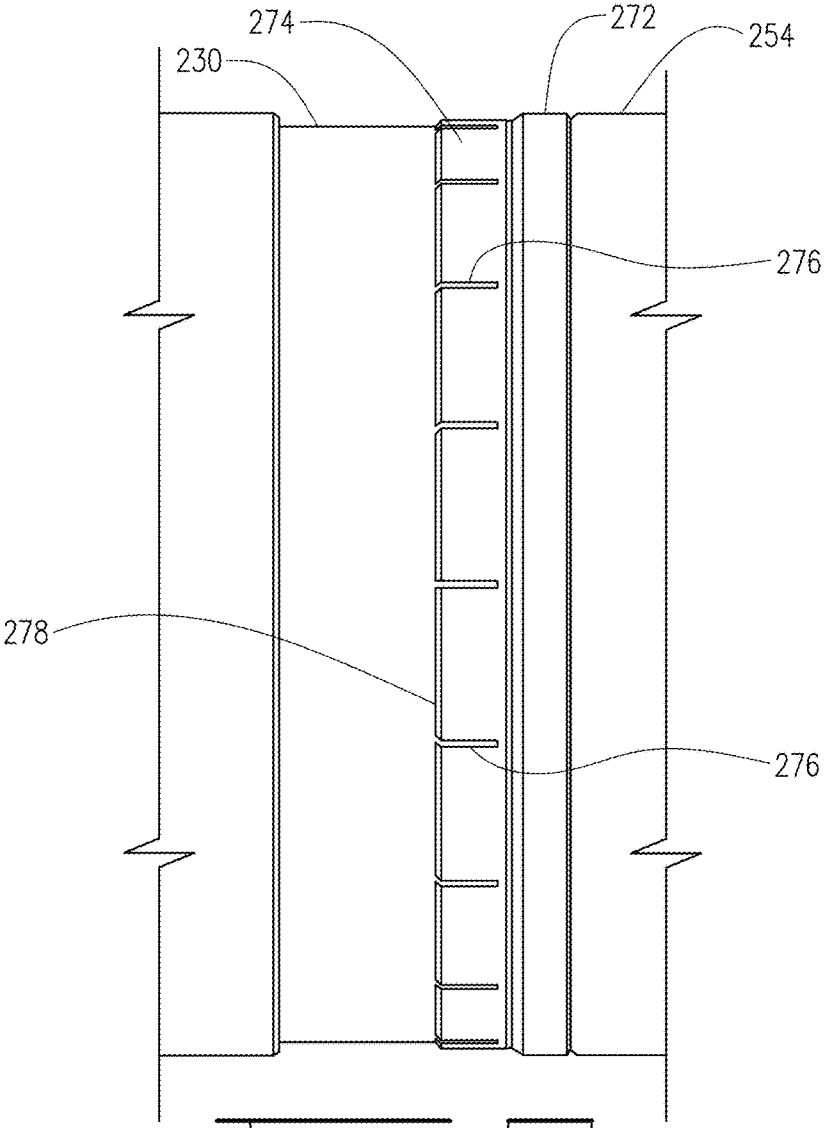
Figure 17:
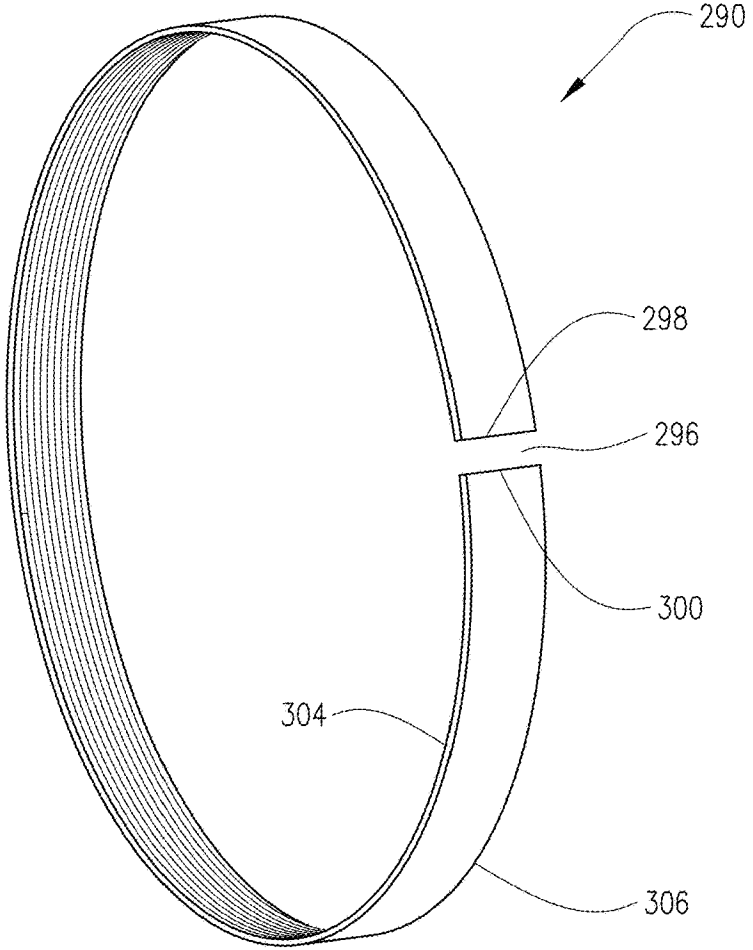
Figure 18:
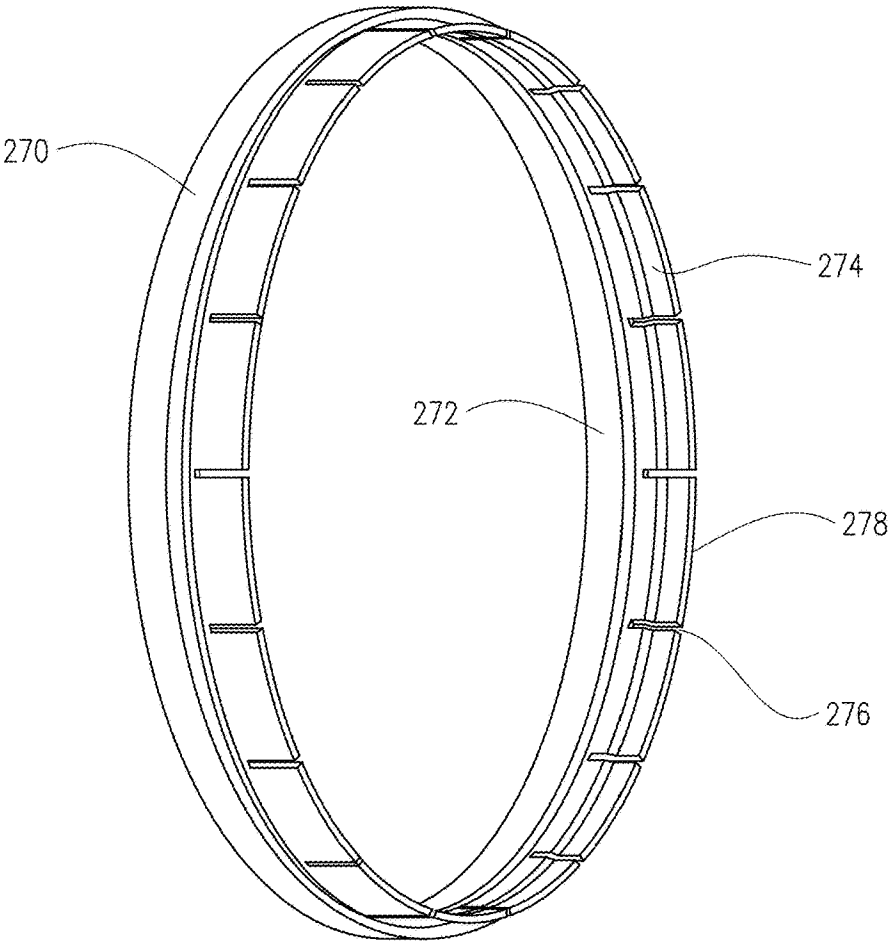
Figure 13:
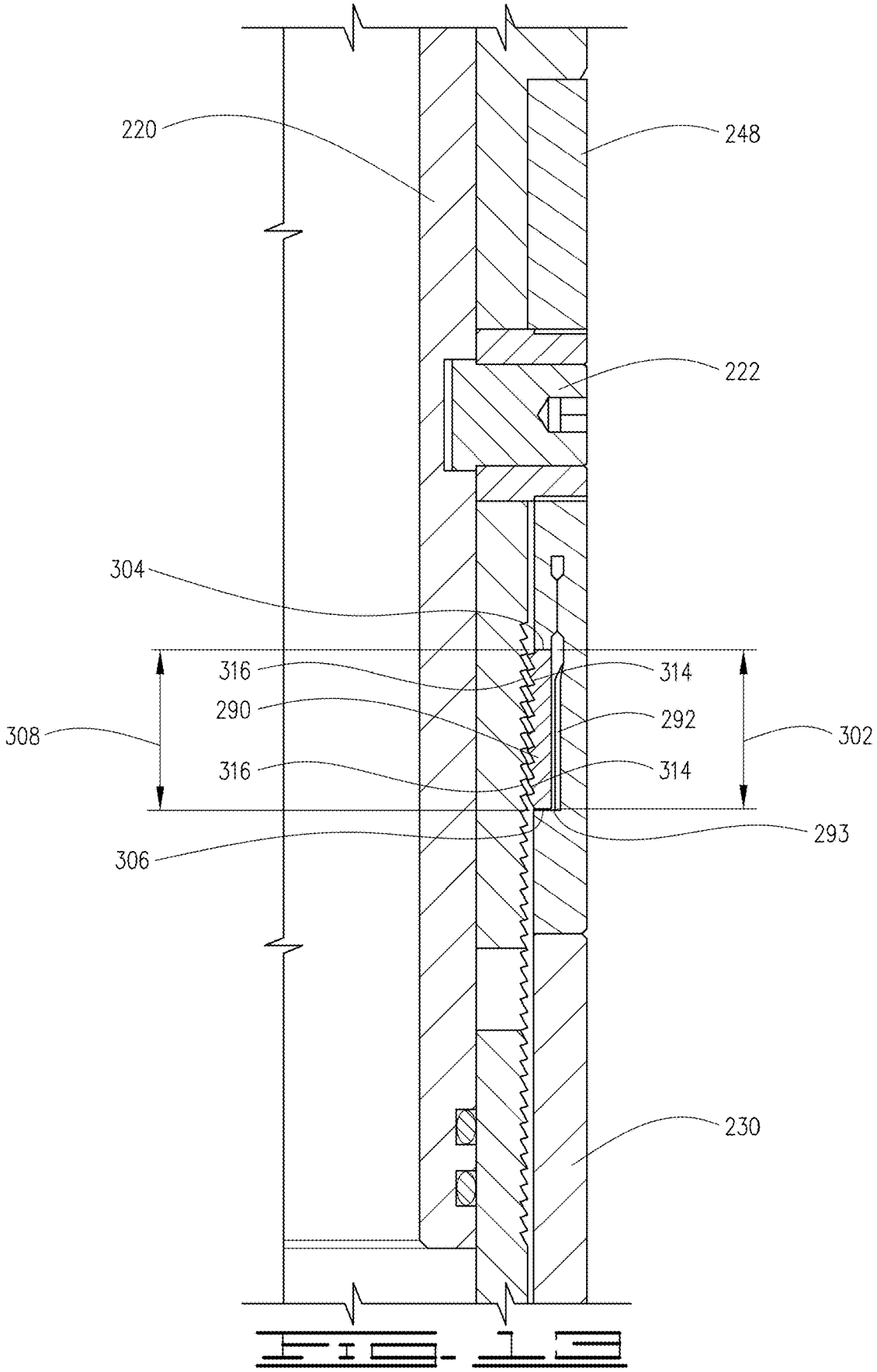
FIG. 13 is a partial cross section showing the lock ring positioned in the packer embodiment of FIG. 5.
Figure 14:
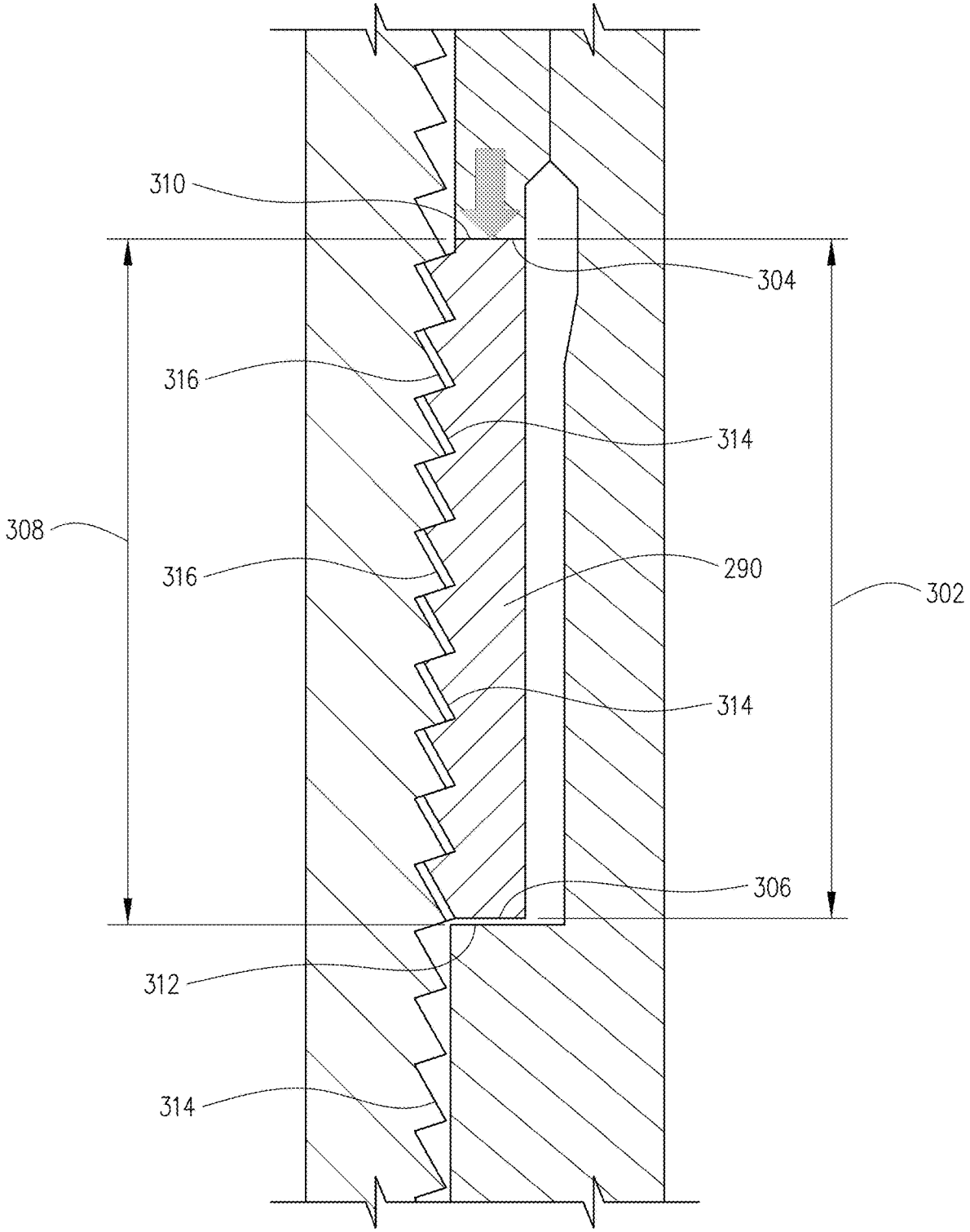
FIG. 14 is an enlarged partial cross section showing the lock ring positioned in the packer embodiment of FIG. 5.

Partial cross sections of an additional embodiment of a packer 200 are shown in FIGS. 5-14. FIG. 5 shows the run-in position. Packer 200 has packer mandrel 202 with outer surface 204 and inner surface 206. Outer surface 204 defines first outer diameter 209, a second outer diameter 210 and a third, reduced outer diameter 212 on reduced diameter portion 213. Packer mandrel 202 has slots 214 defined therein with upper end 216 and lower end 218. A sliding sleeve 220, which is like for example sliding sleeve 40, is disposed in packer mandrel 202 and is connected to a setting sleeve 230 with shearable drive pins 222.

Setting sleeve 230 has first, or upper portion 232 and second, or lower portion 234. First and second portions 232 and 234 may be comprised of different materials, and second portion 234 may be comprised of a softer steel than the first portion. Second portion 234 may comprise a deformable material, such that the setting sleeve is a deformable setting sleeve. An inner surface 236 of setting sleeve 230 defines a first inner diameter 238 and a second, reduced inner diameter 240 on reduced diameter portion 241. The inner surface of setting sleeve 230 will engage the outer surface of packer mandrel 202. Reduced inner diameter portion 241 of setting sleeve 230 will engage reduced diameter portion 213 of packer mandrel 202. An outer surface 242 of setting sleeve 230 defines a first outer diameter 244 and second, reduced outer diameter 246. Setting sleeve 230 has first, or upper end 248 and second, or lower end 250.

Second end 250 defines a wedge 252, referred to as a packer wedge 252, that is positioned under a packer element 254. Wedge 252 defines a ramp 253. Wedge 252 is positioned between reduced diameter portion 213 of packer mandrel 202 and packer element 254. Packer element 254 has first, or upper end 256 and second, or lower end 258. A lower packer shoe 260 captures lower end 258 of packer element 254 and a bottom sub 262, which acts as a cover sleeve 262 is positioned over lower packer shoe 260. The arrangement of lower packer shoe 260 and cover sleeve 262 is like that described with respect to the embodiment of FIG. 2 (lower packer shoe 106 and cover sleeve 90).

An upper packer shoe 270 is positioned over upper end 256 of packer element 254. No cover sleeve is required to hold packer shoe 270 in place. Packer shoe 270 has first and second legs 271 and 273. First leg 271 defines an outer ring 272 and second leg 273 defines a ring shaped skirt 274 extending therefrom. First leg 271 encircles the packer element 254 at the upper end thereof, and second leg 273 encircles the setting sleeve 230 at the lower end 250 thereof. Skirt 274 is a slotted skirt, and has a plurality of slots 276 extending downward from the upper end 278 thereof. Packer assembly 200 has one, and only one cover sleeve, which is positioned to cover the descending leg of lower packer shoe 260. Upper packer shoe 270 is uncovered, and is not restrained by a cover sleeve or other external covering. A gap 275 between first leg 271 and casing 5 in the unset position shown in FIGS. 5 and 6 is small enough such that leg 271 will engage casing 5 when moved to the set position without allowing any extrusion of the packer element around the packer shoe.

A lock ring 290 is disposed about mandrel 202 in an annular space 292 defined between mandrel 202 and setting sleeve 230. A groove 293 defined in setting sleeve 230 may define annular space 292. Lock ring 290 is an annular ring that forms a nearly complete circle, and has a gap 296 between peripheral ends 298 and 300. Lock ring 290 has a length 302 between a first longitudinal end 304 and a second longitudinal end 306. Annular space 292 has a length 308 extending between first and second ends 310 and 312 thereof. Length 302 is slightly shorter than length 308, such that second end 306 will not engage second end 312 of annular space 292. First end 310 of space 292 defines a shoulder 311 that engages first end 304 of lock ring 290. Lock ring 290 has a plurality of teeth 314 that engage mating teeth 316 on mandrel 202. Lock ring 290 is in compression around packer mandrel 202. In other words, the lock ring 290 has a rubber band like relationship so that it squeezes mandrel 202.

In operation, a setting plug will be dropped to engage a plug seat at an upper end of the sliding sleeve 220. Pressure will be increased to move sliding sleeve 220 downward which will move setting sleeve 230 downward and cause wedge 252 at lower end 250 to slide downward under packer element 254. The arrangement of lock ring 290 is such that no load is placed on lock ring 290 during the downward movement. Lock ring 290 will act like a ratchet, so that downward movement is allowed, but no upward movement is allowed. Teeth 314 on lock ring 290 will engage teeth 316 on mandrel 202 to prevent upward movement of setting sleeve 230. As setting sleeve 230 moves down, packer element 254 will expand radially outwardly, both due to compression and the outward force applied by the setting sleeve 230. Packer element 254 in the set position shown in FIG. 7 will fill a gap 320 between the second portion of setting sleeve 230 and casing 5. Setting sleeve 230 will not extend under all of packer element 254 such that a portion of packer element 254 will engage casing 5 as a result of the compression that occurs as a result of the downward push of setting sleeve 230. Thus, packer element 254 seals against casing 5 as a result of both a compressive force resulting from the downward push of the setting sleeve 230, and an outwardly directed force applied by setting sleeve 230 resulting from the sliding sleeve moving under the packer element, which pushes a portion of packer element 254 radially outwardly.

Upper end 278 of packer shoe 270 is chamfered so that it is received in a space 280 defined by a reverse chamfer 281 on the outer surface of setting sleeve 230. Packer shoe 270 is thus captured by the setting sleeve 230 in the set position of the packer 200. More specifically, the upper end 278 of packer shoe 270 is captured by setting sleeve 230. The reverse chamfer will prevent any movement of the shoe 270. Packer 200 thus may be described as a combination propped/non-propped packer. Upper end 256 of packer element 254 is in a propped condition, in that the ramp defined by packer wedge 252 is positioned under packer element 254 at upper end 256 thereof. Lower end 258 of packer element 254 is in a non-propped condition in that the inner surface of packer element 254 is engaged with the packer mandrel 202 at the lower end of packer element 254.

Embodiments include:

Embodiment 1. A packer for use in a well comprising a packer mandrel having a stepped outer surface defining first, second and third progressively smaller outer diameters, the third outer diameter defining a reduced outer diameter portion. A setting sleeve is disposed about the packer mandrel, and has a stepped inner surface defining first and second inner diameters, the second inner diameter being smaller than the first inner diameter and defining a reduced inner diameter, the setting sleeve engaged with and slidable on the second and third outer diameters on the outer surface of the packer mandrel, and a packer element disposed about the reduced outer diameter portion of the packer mandrel, the setting sleeve movable from a first position to a second position on the packer mandrel to move the packer to a set position.

Embodiment 2. The packer of embodiment 1, an outer surface of the packer element in the unset position being in alignment with an outermost surface of the packer mandrel.

Embodiment 3. The packer of embodiment 2, the first outer diameter on the outer surface of the packer mandrel defining the outermost surface of the packer mandrel.

Embodiment 4. The packer of any of embodiments 1-3 further comprising an upper annular support shoe at an upper end of the packer element; a lower annular support shoe at the lower end of the packer element; and at least one cover sleeve disposed about the mandrel capturing a portion of one of the upper and lower annular support shoes between the at least one cover sleeve and the mandrel.

Embodiment 5. The packer of embodiment 4, the lower annular support shoe comprising a first leg encircling a lower end of the packer element and a second leg encircling the packer mandrel, the at least one cover sleeve comprising a single cover sleeve disposed about the second leg of the lower annular support shoe, the upper annular support shoe having an uncovered upper surface.

Embodiment 6. The packer of any of embodiments 1-5, one of the upper and lower ends of the packer element being in a propped element configuration, the other of the upper and lower ends of the packer element comprising a non-propped element configuration.

Embodiment 7. The packer of embodiment 6, the setting sleeve comprising a wedge shaped lower end positioned between the packer element at the upper end thereof and the packer mandrel, the packer further comprising a cover sleeve with an annular flat face adjacent the lower end of the packer.

Embodiment 8. A packer assembly comprising a packer mandrel having an outer surface defining first, second and third progressively smaller outer diameters and a packer element disposed about the third outer diameter. A setting sleeve is slidable on the second and third outer diameters from a first to a second position, the packer element moved to a set position when the setting sleeve moves to the second position, the setting sleeve having an inner surface defining first and second inner diameters engaged with and slidable on the packer mandrel. An upper support shoe is disposed about the setting sleeve and extends over an upper end of the packer element. A lower support shoe is disposed about the mandrel and extends over a lower end of the sealing element. The packer assembly includes one and only one cover sleeve, the only one cover sleeve capturing a leg of the lower support shoe between the cover sleeve and the packer mandrel.

Embodiment 9. The packer assembly of embodiment 8, the setting sleeve comprising a wedge shaped lower end positioned between the packer element at the upper end thereof and the packer, the upper support shoe having a first leg and a second leg, the second leg extending over the packer element and the first leg extending over the setting sleeve.

Embodiment 10. The packer assembly of embodiment 9, the first leg of the upper support shoe defining a chamfer at the upper end thereof, the outer surface of the setting sleeve defining a reverse chamfer, wherein in the second position of the setting sleeve, the upper end of the first leg of the upper support shoe is captured in the reverse chamfer.

Embodiment 11. The packer assembly of either of embodiments 9 or 10, the first leg of the upper support shoe having a plurality of slots extending downwardly from an upper end thereof.

Embodiment 12. The packer assembly of any of embodiments 9-11, the lower end of the packer element being in a non-propped configuration such that the inner surface of the packer element at the lower end thereof maintains engagement with the packer mandrel in the set position of the packer assembly.

Embodiment 13. The packer assembly of any of embodiments 9-12, the packer element defining a packer element outer surface that is aligned with the outermost diameter of the packer mandrel in a run-in position of the packer assembly.

Embodiment 14. The packer assembly of any of embodiments 9-13, further comprising a locking element positioned between the setting sleeve and the packer mandrel, the locking element configured to lock the setting sleeve in its second position.

Embodiment 15. A packer assembly for use in a well comprising a packer mandrel having a stepped outer surface defining first, second and third diameters, the third diameter defining a reduced diameter packer element support. The packer assembly has a setting sleeve having a stepped inner surface defining first and second progressively smaller inner diameters, the second inner diameter being engaged with and slidable on the reduced diameter packer element support; and a packer element movable from an unset to a set position disposed about the packer mandrel on the reduced diameter packer element support, the packer element having an unset outer diameter that is substantially the same size as an outermost diameter of the packer mandrel.

Embodiment 16. The packer assembly of embodiment 15 further comprising an upper annular support shoe at an upper end of the packer element, a lower annular support shoe at a lower end of the packer element; and a cover sleeve disposed about a leg of the lower annular support.

Embodiment 17. The packer assembly of embodiment 16, the upper end of the packer element being in a propped configuration and the lower end of the packer element being in a non-propped configuration.

Embodiment 18. The packer assembly of either of embodiments 16 or 17, the setting sleeve having upper and lower portions, the upper and lower portions comprised of different materials.

Embodiment 19. The packer assembly of any of embodiments 16-18, the setting sleeve comprising a ramp at a lower end thereof, the ramp positioned between the packer element at an upper end thereof and the packer mandrel.

Embodiment 20. The packer assembly of embodiment 19, wherein when the packer assembly is moved to the set position the lower end of the packer element is pressed against a flat annular surface and the upper end of the packer element is urged radially outwardly as the setting sleeve moves downwardly and under the packer element.

Although various embodiments have been shown and described, the disclosure is not limited to such embodiments and will be understood to include all modifications and variations as would be apparent to one skilled in the art. Therefore, it should be understood that the disclosure is not intended to be limited to the particular forms disclosed; rather, the intention is to cover all modifications, equivalents, and alternatives falling within the spirit and scope of the disclosure as defined by the appended claims.

What is claimed is:

1. A packer for use in a well comprising:

a packer mandrel having a stepped outer surface defining first, second and third progressively smaller outer diameters, the third outer diameter defining a reduced outer diameter portion;

a setting sleeve disposed about the packer mandrel, the setting sleeve having a stepped inner surface defining first and second inner diameters, the second inner diameter being smaller than the first inner diameter and defining a reduced inner diameter, the setting sleeve engaged with and slidable on the second and third outer diameters on the outer surface of the packer mandrel; and a packer element having upper and lower ends disposed about the reduced outer diameter portion of the packer mandrel, the setting sleeve movable from a first position to a second position on the packer mandrel to move the packer to a set position, one of the upper and lower ends of the packer element being in a propped element configuration, the other of the upper and lower ends of the packer element comprising a non-propped element configuration.

2. The packer of claim 1, an outer surface of the packer element in the unset position being in alignment with an outermost surface of the packer mandrel.

3. The packer of claim 2, the first outer diameter on the outer surface of the packer mandrel defining the outermost surface of the packer mandrel.

4. The packer of claim 1 further comprising:

an upper annular support shoe at as the upper end of the packer element;

a lower annular support shoe at the lower end of the packer element; and at least one cover sleeve disposed about the mandrel capturing a portion of one of the upper and lower annular support shoes between the at least one cover sleeve and the mandrel.

5. The packer of claim 4, the lower annular support shoe comprising a first leg encircling a lower end of the packer element and a second leg encircling the packer mandrel, the at least one cover sleeve comprising a single cover sleeve disposed about the second leg of the lower annular support shoe, the upper annular support shoe having an uncovered upper surface.

6. The packer of claim 1, the setting sleeve comprising a wedge shaped lower end positioned between the packer element at the upper end thereof and the packer mandrel, the packer further comprising a cover sleeve with an annular flat face adjacent the lower end of the packer.

7. A packer assembly comprising:

a packer mandrel having an outer surface defining first, second and third progressively smaller outer diameters;

a packer element disposed about the third outer diameter;

a setting sleeve slidable on the second and third outer diameters from a first to a second position, the packer element moved to a set position when the setting sleeve moves to the second position, the setting sleeve having an inner surface defining first and second inner diameters engaged with and slidable on the packer mandrel;

an upper support shoe disposed about the setting sleeve and extending over an upper end of the packer element;

a lower support shoe disposed about the mandrel and extending over a lower end of the sealing element; and one and only one cover sleeve, the only one cover sleeve capturing a leg of the lower support shoe between the cover sleeve and the packer mandrel.

8. The packer assembly of claim 7, the setting sleeve comprising a wedge shaped lower end positioned between the packer element at the upper end thereof and the packer, the upper support shoe having a first leg and a second leg, the second leg extending over the packer element and the first leg extending over the setting sleeve.

9. The packer assembly of claim 8, first leg of the upper support shoe defining a chamfer at the upper end thereof, the outer surface of the setting sleeve defining a reverse chamfer, wherein in the second position of the setting sleeve, the upper end of the first leg of the upper support shoe is captured in the reverse chamfer.

10. The packer assembly of claim 8, first leg of the upper support shoe having a plurality of slots extending downwardly from an upper end thereof.

11. The packer assembly of claim 8, the lower end of the packer element being in a non-propped configuration such that the inner surface of the packer element at the lower end thereof maintains engagement with the packer mandrel in the set position of the packer assembly.

12. The packer assembly of claim 8, the packer element defining a packer element outer surface that is aligned with the outermost diameter of the packer mandrel in a run-in position of the packer assembly.

13. The packer assembly of claim 8, further comprising a locking element positioned between the setting sleeve and the packer mandrel, the locking element configured to lock the setting sleeve in its second position.

14. A packer assembly for use in a well comprising:

a packer mandrel having a stepped outer surface defining first, second and third diameters, the third diameter defining a reduced diameter packer element support;

a setting sleeve having a stepped inner surface defining first and second progressively smaller inner diameters, the second inner diameter being engaged with and slidable on the reduced diameter packer element support; and a packer element movable from an unset to a set position disposed about the packer mandrel on the reduced diameter packer element support, the packer element having an unset outer diameter that is substantially the same size as an outermost diameter of the packer mandrel.

15. The packer mandrel of claim 14 further comprising:

an upper annular support shoe at an upper end of the packer element;

a lower annular support shoe at a lower end of the packer element; and a cover sleeve disposed about a leg of the lower annular support.

16. The packer assembly of claim 15, the upper end of the packer element being in a propped configuration and the lower end of the packer element being in a non-propped configuration.

17. The packer assembly of claim 15, the setting sleeve having upper and lower portions, the upper and lower portions comprised of different materials.

18. The packer assembly of claim 15, the setting sleeve comprising a ramp at a lower end thereof, the ramp positioned between the packer element at an upper end thereof and the packer mandrel.

19. The packer assembly of claim 18, wherein when the packer assembly is moved to the set position the lower end of the packer element is pressed against a flat annular surface and the upper end of the packer element is urged radially outwardly as the setting sleeve moves downwardly and under the packer element.

* * * * *